United States Patent [19]

Ritten et al.

[11] Patent Number: 4,726,317

[45] Date of Patent: Feb. 23, 1988

[54] LADDERS FOR STERN PLATFORMS OF BOATS

[75] Inventors: Robert G. Ritten; John L. Terry, both of Ft. Pierce, Fla.

[73] Assignee: Step-On Inc., Ft. Pierce, Fla.

[21] Appl. No.: 901,628

[22] Filed: Aug. 29, 1986

[51] Int. Cl.[4] ..... B63B 29/20

[52] U.S. Cl. ..... 114/362; 114/363; 182/91

[58] Field of Search ..... 114/363, 280, 364, 362, 114/343; 280/166; 182/91, 86, 35, 33-36, 83, 85, 97

[56] References Cited

U.S. PATENT DOCUMENTS

| | | | |
|---|---|---|---|
| 2,197,266 | 4/1940 | Fredell | 182/91 |
| 3,195,680 | 7/1965 | Thornburg | 182/92 |
| 3,794,140 | 2/1974 | Sell | 114/362 |
| 4,186,820 | 2/1980 | Cosman | 114/362 |
| 4,462,485 | 7/1984 | Terry | 114/363 |

*Primary Examiner*—Galen Barefoot

*Assistant Examiner*—Clifford T. Bartz

*Attorney, Agent, or Firm*—Carroll F. Palmer

[57] ABSTRACT

Ladders for the transoms of boats having stern platforms thereon include a fixed upper unit and a pivoted lower unit. The upper unit has a pair of tubular brackets fastened to the stern platform with portions that depend below the platform. The lower unit has a tubular member formed with a central section and two integral, parallel and identical end sections. The end sections are spaced apart approximately the distance between the upper unit brackets and planking extends between them forming one or more steps. The end sections of the lower unit are hinged to the upper unit brackets so the lower unit may be moved between a raised position where the step is positioned above a stern platform and a lowered position where the step or steps are positioned below and astern of the platform. In one embodiment, the upper unit has posts that serve to engage legs of the end sections when the lower unit is in the lowered position to limit its downward movement.

14 Claims, 12 Drawing Figures

LADDERS FOR STERN PLATFORMS OF BOATS

BACKGROUND OF THE INVENTION

1. Field of the Invention

The invention relates broadly to ladders to be attached to the transoms of boats in assist persons using the boats to board the boat from a position immersed in the water beside the boat or to safely debark from the boat even when loaded with scuba equipment or other gear. More particularly, it concerns boat ladders that may be attached to a stern platform of a boat to provide a foldable step section that permits easy and safe access from or to the platform into or out of the water surrounding the boat.

2. Description of the Prior Art

A variety of platform and ladder devices have been developed and marketed for attachment to the transoms of boats to assist in boarding or debarking the boats or to help in moving or working about the stern of the boats. These prior devices can be divided broadly into three classes, i.e., (1) those that are strictly ladders and provide no real platform function, (2) those that are strictly platforms and (3) those that provide combination ladder and platform functions. The present invention relates the devices of the third type.

Many prior art devices of the third type have the moveable step sections mounted to the platform section in a manner that the step section is not sturdily fixed when in the lowered, climbing position with the result that the user is bothered by having to lift his body on an unsteady step. This is particularly bothersome when the user is carrying heavy gear, e.g., scuba gear, since the added weight serves to aggravate the unstable condition. We previously disclosed and claimed in our prior patent U.S. Pat. No. 4,462,485 improved ladder platforms which eliminated such deficiency of the prior known devices. However, the devices of that patent were not designed for use with boats already equipped with stern platforms so this present invention fills the gap.

OBJECTS

A principal object of the present invention is the provision of new improvements in boat ladders for mounting on boats equipped with stern platforms.

Further objects include the provision of:

1. New forms of ladders for attachement to the transoms of boats.

2. Such ladders having moveable step sections in which the step section when in the lowered, climbing position is fixed against swinging or other movement so a user is presented with a steady step or steps upon which to lift his body and any gear which he carriers.

3. New boat ladder-platform combinations having improved safety and function features.

Other objects and further scope of aplicability of the present invention will become apparent from the detailed description given hereinafter; it should be understood, however, that the detailed description, while indicating preferred embodiments of the invention, is given by way of illustration only, since various changes and modifications within the spirit and scope of the invention will become apparent to those skilled in the art from this detailed description.

SUMMARY OF THE INVENTION

These objects are accomplished according to the present invention by the provision of new ladder devices for attachment to stern platforms of boats that comprise a a fixed upper unit and a pivoted lower unit.

The upper unit comprises a pair of tubular brackets fastened to the stern platform, each bracket including a U-shaped portion that has a vertical fore section with a free end and a vertical aft section. In one embodiment, posts are fixed to each of the fore sections to extend laterally thereof and the pair of posts are positioned in a common plane perpendicular to the longitudinal axis of the U-shaped portions.

The brackets also have an L-shaped portion integral with the U-shaped portion with the short leg of the L-shaped portion turned toward the U-shaped portion and the free end of the short leg. In one embodiment, the free end of the short leg has a threaded plug welded therein and the fore section of each of the U-shaped portion of each bracket has a threaded plug welded into the free end thereof whereby the brackets may be fixed to the platform by bolts that extend through the platform and thread into the plugs. In other embodiments, the brackets are fitted to the platform by quick-release pins.

The lower unit comprises a tubular member defined by a central section and two parallel end sections integral with the central section disposed in planes substantially perpendicular to the central section. The end sections are substantially identical and comprise a first short leg joined at one end to the central section, a long leg joined at one end to the other end of the first short leg and a second short leg joined at one end to the other end of the long leg. The legs of each end section are in one plane with the long leg being approximately perpendicular to the first short leg and the second short leg extends from the long leg at an acute angle toward the first short leg.

The end sections are spaced apart approximately the distance between the brackets and planking is fixed to the second short legs of the end sections spanning the distance between them and forming one or more steps.

The end sections of the lower unit are hinged to the aft sections of the U-shaped portions of the brackets adjacent the corner where the first short leg in the end sections joins the respective long leg and the lower unit may be moved between a raised position where the step is positioned above the platform and a lowered position where the step is positioned below and astern of the platform.

In the lowered position, posts of the upper unit may serve to engage the first short legs of the end sections to limit the downward movement of the lower unit.

BRIEF DESCRIPTION OF THE DRAWINGS

A more complete understanding of the invention may be had by reference to the accompanying drawings in which.

DESCRIPTION OF THE PREFERRED EMBODIMENTS

Figure 1:
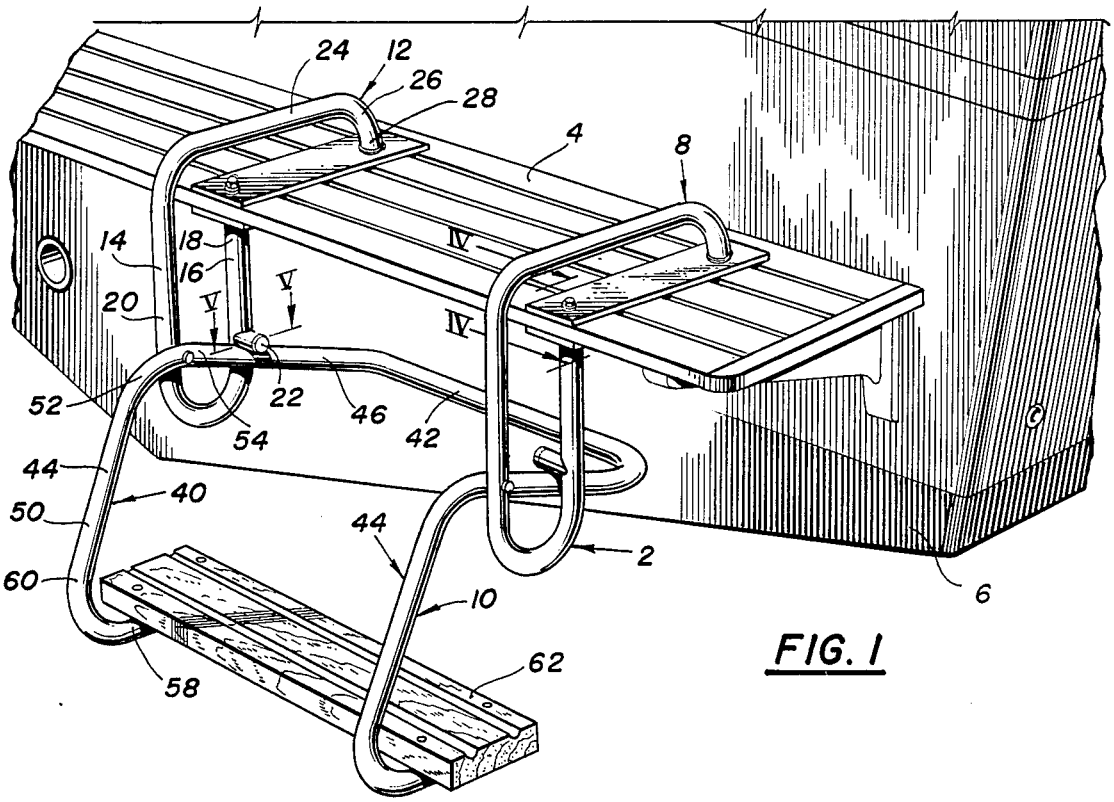
FIG. 1 is a fragmentary, perspective view of the stern of a boat equipped with a first embodiment of ladder devices of the invention.

Referring in detail to the drawings, in which identical parts are identically marked, the invention in a first embodiment concerns a ladder device 2 for attachment to stern platform 4 of the boat 6 and comprises a fixed upper unit 8 and a pivoted lower unit 10.

The upper unit 8 comprises a pair of tubular brackets 12 fastened to the stern platform 4. Each bracket 12 includes a U-shaped portion 14 that depends below the platform 4 that has a vertical fore section 16 with an upper free end 18 and a vertical aft section 20. Posts 22 are fixed, such as by welding to each of the fore sections 16 to extend laterally thereof. The open ends of the tubular posts 22 may be capped with plastics plugs 23.

The brackets 12 also have an L-shaped portion 24 integral with the U-shaped portion 14 with the short leg 26 of the L-shaped portion 24 turned toward the U-shaped portion 14 and the free 28 end of the short leg 26 has a threaded plug (not shown) welded therein. Similarly, the fore section 16 of each of the U-shaped portions 14 has a threaded plug 30 welded into the upper free end 18 and the brackets 12 are fixed to the platform 4 by bolts 32 that extend through the platform 4 and thread into the plugs 30.

The lower unit 10 comprises a tubular member 40 with a central section 42 and two parallel end sections 44 integral with the central section 42 disposed in planes substantially perpendicular thereto. The end sections 44 are substantially identical and comprise a first short leg 46 joined at one end 48 to the central section 42, a long leg 50 joined at one end 52 to the other end 54 of the first short leg 46 and a second short leg 56 joined at one end 58 to the other end 60 of the long leg 50.

The legs of each end section 44 are in one plane with the long leg 50 being approximately perpendicular to the first short leg 46 and the second short leg 56 extends from the long leg 50 at an acute angle toward the first short leg 46.

The end sections 44 are spaced apart approximately the distance between the brackets 8 and planking 62 is fixed to the second short legs 56 spanning the distance between them and forming a step.

Figure 2:
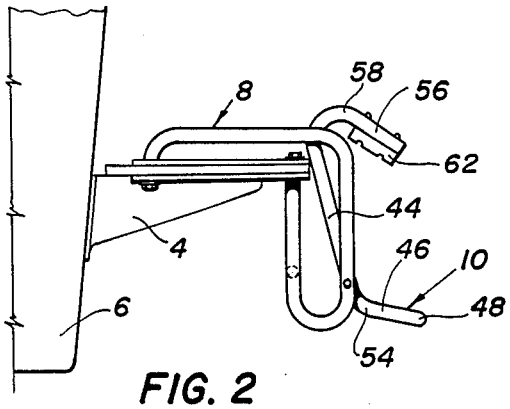
FIG. 2 is a fragmentary, lateral view of the ladder device of FIG. 1 with the lower unit thereof in its raised position.
Figure 4:
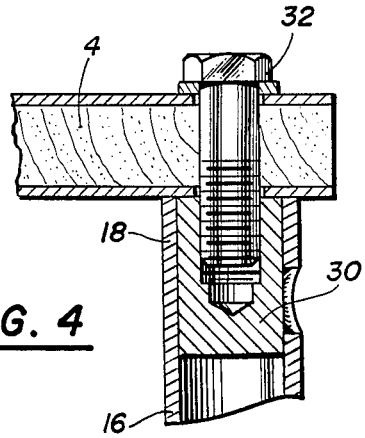
FIG. 4 is an enlarged, fragmentary, sectional view taken on the line IV—IV of FIG. 1.
Figure 3:
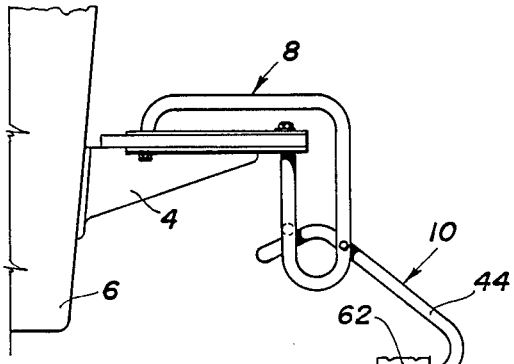
FIG. 3 is a fragmentary, lateral view of the ladder device of FIG. 1 with the lower unit thereof in its lowered position.
Figure 5:
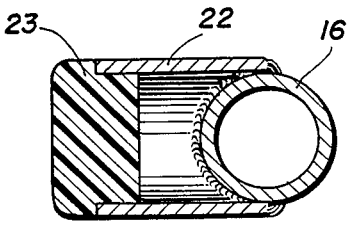
FIG. 5 is an enlarged, fragmentary, sectional view taken on the line V—V of FIG. 1.
Figure 6:
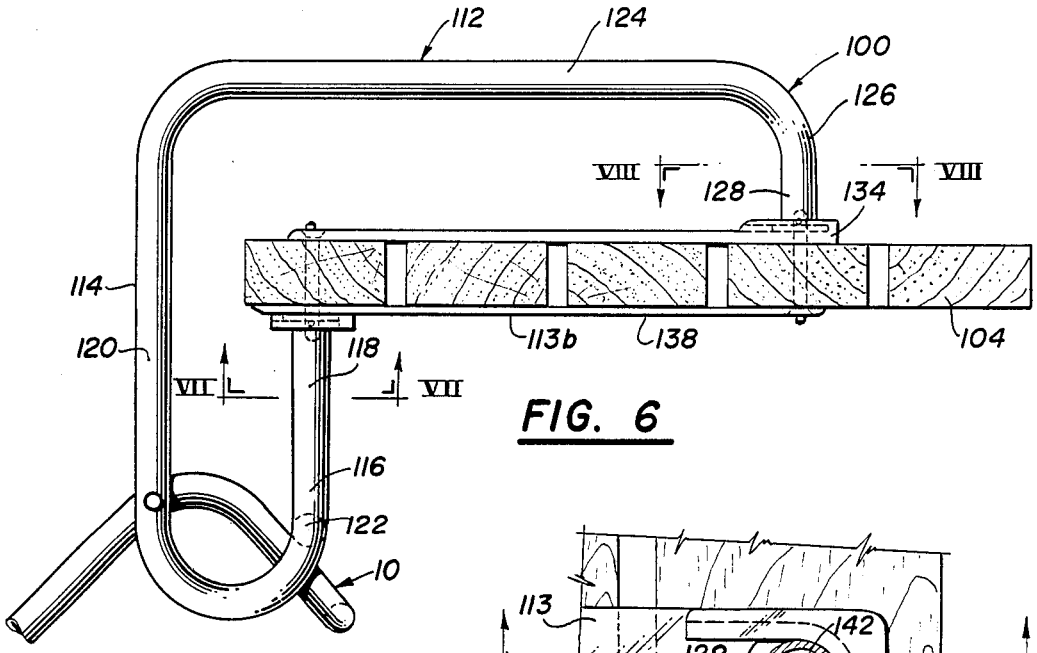
FIG. 6 is a lateral view of a second embodiment of a ladder device of the invention.
Figure 8:
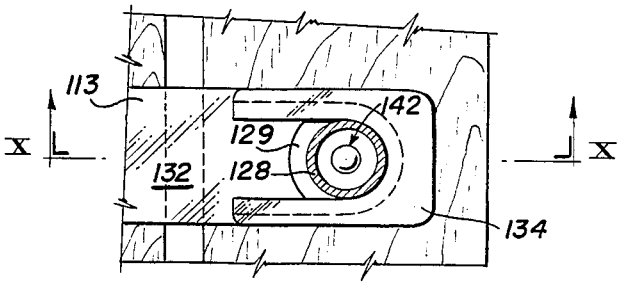
FIG. 8 is a sectional view taken on the line VIII—VIII of FIG. 6.
Figure 7:
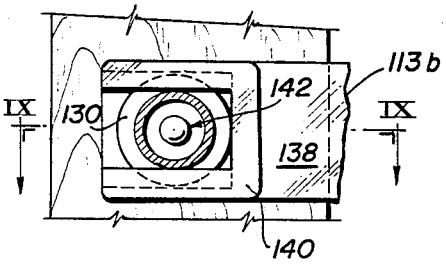
FIG. 7 is a sectional view taken on the line VII—VII of FIG. 6.
Figure 9:
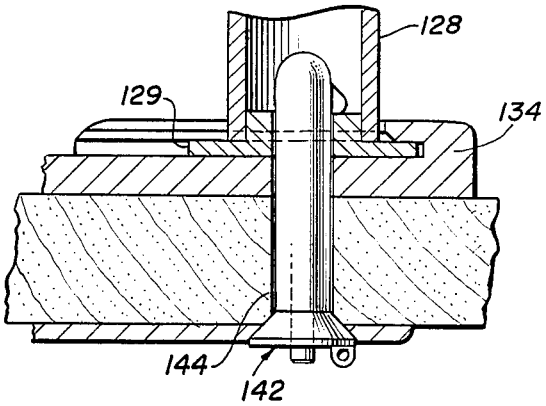
FIG. 9 is a sectional view taken on the line IX—IX of FIG. 7.
Figure 10:
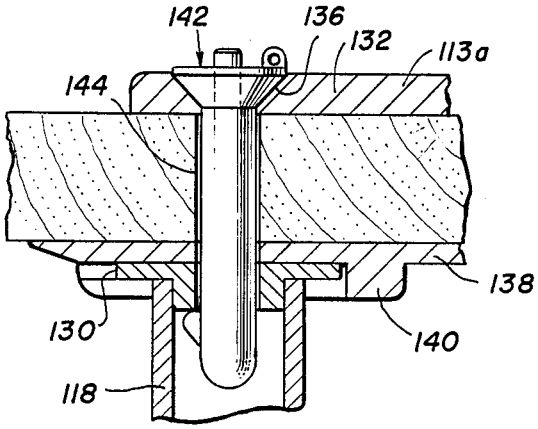
FIG. 10 is a sectional view taken on the line X—X of FIG. 8.

The end sections 44 are hinged to the aft sections 16 of the brackets 8 adjacent the corner where the first short leg 46 joins the respective long leg 50 so the lower unit 10 may be moved between a raised position (FIG. 2) where the planking (step) 62 is positioned above the platform 4 and a lowered position (FIG. 3) where the step 62 is positioned below and astern of the platform 4. In the lowered position, the posts 22 serve to engage the first short legs 46 to limit the downward movement of the lower unit 10.

While the lower ladder unit 10 has been shown and described as having only one step 62, such sections may include two or more steps (not shown) if desired. Further, while the new ladder devices of the invention are defined in the appended claims in terms of attachment to the platform of a boat, it is to be understood that the claims are intended to cover the separate ladder hardware as supplied for mounting in the manner defined on the transom platform of a boat. The new ladder devices may be mounted and used on stern boat platforms that are fixed or that are foldable.

Teak is a preferred wood for the planking (steps) 62, but marine plywood, oak or the like can be used. Also, stainless steel or other metals resistant to corrosion by salt water, e.g., aluminum, cortez steel, glass fibers panels, molded plastics, etc. may be substituted for the wood planking.

The second embodiment 100 of ladder devices of the invention comprises a fixed upper unit 108 and pivoted lower unit 10.

The upper unit 108 comprises a pair of tubular brackets 112 fitted to the stern platform 104 by a pair of mounting plates 113*a* and 113*b*. Each bracket 112 includes a U-shaped portion 114 that depends below the platform 4 having a vertical fore section 116 with an upper free end 118 and a vertical aft section 120. Posts 122 are fixed, such as by welding to each of the fore sections 116 to extend laterally thereof. The open ends of the tubular posts 122 may be capped with plastics plugs.

The brackets 112 also have an L-shaped portion 124 integral with the U-shaped portion 114 with the short leg 126 of the L-shaped portion 24 turned toward the U-shaped portion 114 and the free 128 end of the short leg 126 has a flat washer 129 welded thereon. Similarly, the fore section 116 of each of the U-shaped portions 114 has flat washer 130 welded into the upper free end 118.

The mounting plate 113*a* and 113*b* may be identical (not shown) or one may be thinner in parts than the other as shown. Plate 113*a* comprises a longitudinal strip 132 having a channelled portion 134 at one end and a countersunk hole 136 at the other end. Plate 113*b* comprises a longitudinal strip 138 having a channelled portion 140 at one end and a countersunk hole 142 at the other end.

The mounting plates 113*a* and 113*b* plus the brackets 112 are fixed to the stern platform 104 by quick-release pins 142 that extend through holes 144 made in the platform 104 to couple together, as shown, the plates 113*a*, 113*b* and the brackets 112. The ladder devices 100 may be quickly put on or removed from the platform 104 by manipulation of the pins 142 in known manner to fasten together or disassemble the plates and brackets. If desired, the plates 113*a* & 113*b* may be permanently fixed to the platform 104 by adhesive or fasteners or they may be left free to be removed when desired with the brackets 112 and the lower unit 10.

Figure 11:
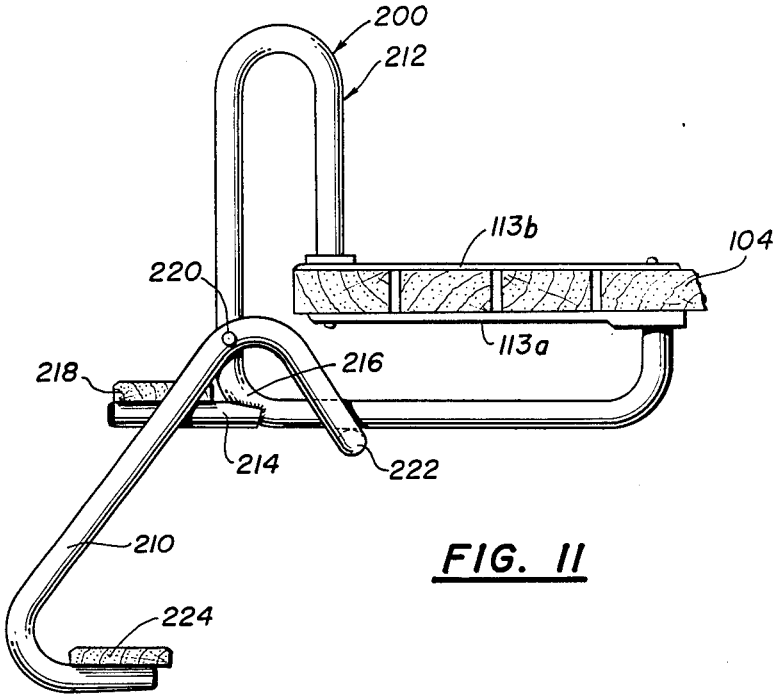
FIG. 11 is a lateral view of a third embodiment of a ladder device of the invention.

The ladder device 200 shown in FIG. 11 is basically similar to the device 100 and comprises lower unit 210 and tubular brackets 212 except that brackets 212 are inverted in comparison to brackets 112. Also, brackets 212 have tubular extensions 214 welded thereon at the bend 216 to form a support for an upper step 218. Another difference in brackets 212 as compared to brackets 112 is the position of pivot pin 220 for the lower unit 210.

Lower unit 210 differs from unit 110 in having a wider central section 222 so that the unit 210 fits on the outside of the brackets 212 rather than on the inside as unit 110 does with the brackets 112.

Figure 12:
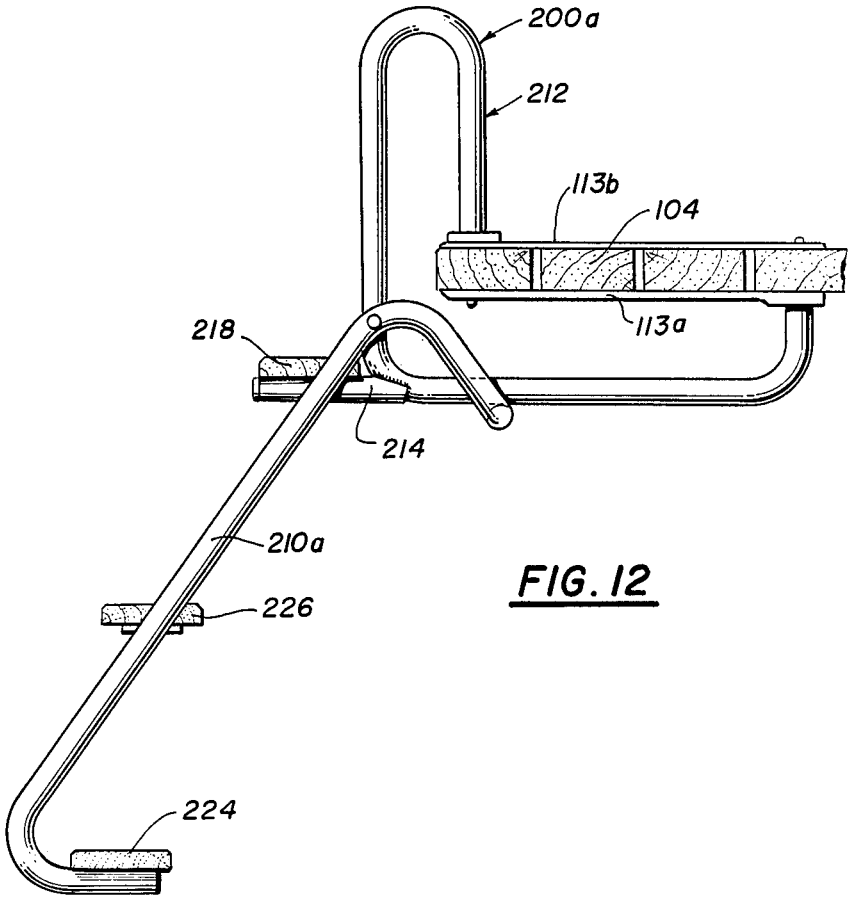
FIG. 12 is a lateral view of a fourth embodiment of a ladder device of the invention.

The ladder device 200a of FIG. 12 differs from the device 200 of FIG. 11 by having a longer lower unit 210a equipped with two steps 224 and 226 rather than just one step 224 as with device 200.

The ladder device 200a is advantageous for use by persons of limited agility that require a lower step that is immersed deeper in the water than can be attained with a single step unit such as ladder device 200. Also, the upper extending arrangment of the brackets 212, as compared to the lower profile brackets 112, provide hand-holds above the platform 104 to further assist such persons of restricted agility to climb out of the water onto the platform 104.

In all forms of the ladder devices of the invention, they can be quickly installed on any boat equipped with a stern platform simply by drilling four, properly spaced holes in the platform. When so mounted, the lower units fold up to eliminate drag in the water while the boat is underway and fold down when stopped to provide boat riders easy movement in and out of the water.

While in the foregoing specification and in the appended claims, the description of the invention for the sake of brevity refers to the new ladder devices as being attached to the platform of a boat, it will be understood that the devices will be marketed as assemblies for attachment to boat platforms so the claims are intended to cover the new ladder devices in such marketed form as well as when installed on a boat platform.

The embodiments of the invention in which an exclusive property or privilege is claimed are defined as follows:

1. A ladder for the transom of a boat having a stern platform thereon which comprises:

a fixed upper unit and a pivoted lower unit, said upper unit comprising a pair of tubular brackets fastened to said stern platform each including a U-shaped portion that depends from said platform, said U-shaped portion having a vertical fore section and a vertical aft section, and a post fixed to each said fore section and extending laterally thereof, said posts being positioned in a common plane perpendicular to the longitudinal axis of said U-shaped portions, said lower unit comprising a tubular member defined by a central section and two parallel end sections integral with said central section disposed in planes substantially perpendicular to said central section, said end sections being substantially identical and comprising a first short leg joined at one end to said central section, a long leg joined at one end to the other end of said first short leg and a second short leg joined at one end to the other end of said long leg, said legs of each end section all lying in one plane with said long leg being approximately perpendicular to said first short leg and said second short leg extending from said long leg at an acute angle toward said first short leg, said end sections being spaced apart approximately the distance between said brackets and planking fixed to said second short legs of said end sections spanning the distance between them and forming a step, said end sections of said lower unit being hinged to said aft sections of said U-shaped portions of said brackets adjacent the corner where said first short leg in said end sections joins the respective long leg whereby said lower unit may be moved between a raised position where said step is positioned above said platform and a lowered position where said step is positioned below and astern of said platform, said posts serving to engage said first short legs of said end sections when said lower unit is in said lowered position to limit the downward movement of said lower unit in said lowered position.

2. The ladder of claim 1 wherein said planking is wood.

3. The ladder of claim 1 wherein said planking is metal.

4. The ladder of claim 1 wherein said tubular members are formed from a length of tubing.

5. The ladder of claim 1 wherein said posts are on the inside of said brackets and point toward each other.

6. The ladder of claim 5 wherein said lower unit end sections are positioned between said brackets.

7. The ladder of claim 1 wherein said brackets have and L-shaped portion integral with said U-shaped portion with the short leg of said L-shaped portion turned toward said U-shaped portion and the free end of said short leg has a threaded plug welded therein.

8. The ladder of claim 7 wherein said fore section of said U-shaped portion of each bracket has a threaded plug welded into the upper free end thereof.

9. The ladder of claim 8 wherein said brackets are fixed to said platform by bolts that extend through said platform and thread into said plugs.

10. A ladder for the transom of a boat having a stern platform thereon which comprises:

a fixed upper unit and a pivoted lower unit;

said upper unit comprising a pair of tubular brackets fastened to said stern platform each including a U-shaped portion that depends below said platform, said U-shaped portion having a vertical fore section with an upper free end and a vertical aft section, a post fixed to each said fore section and extending laterally thereof, said posts being positioned in a common plane perpendicular to the longitudinal axis of said U-shaped portions, and an L-shaped portion integral with said U-shaped portion with the short leg of said L-shaped portion turned toward said U-shaped portion and the free end of said short leg having a threaded plug welded therein, and said fore section of each of said U-shaped portion of each bracket has a threaded plug welded into said upper free end thereof;

said brackets being fixed to said platform by bolts that extend through said platform and thread into said plugs;

said lower unit comprising a tubular member defined by a central section and two parallel end sections integral with said central section disposed in planes substantially perpendicular to said central section, said end sections being substantially identical and comprising a first short leg joined at one end to said central section, a long leg joined at one end to the other end of said first short leg and a second short leg joined at one end to the other end of said long leg, said legs of each end section all lying in one plane with said long leg being approximately perpendicular to said first short leg and said second short leg extending from said long leg at an acute angle toward said first short leg, said end sections being spaced apart approximately the distance between said brackets and planking fixed to said second short legs of said end sections spanning the distance between them and forming a step, said end sections of said lower unit being hinged to said aft sections of said U-shaped portions of said brackets adjacent the corner where said first short leg in said end sections joins the respective long leg whereby said lower unit may be moved between a raised position where said step is positioned above said platform and a lowered position where said step is positioned below and astern of said platform, said posts serving to engage said first short legs of said end sections when said lower unit is in said lowered position to limit the downward movement of said lower unit in said lowered position.

11. A ladder for the transom of a boat having a stern platform thereon which comprises:

a fixed upper unit and a pivoted lower unit, said upper unit comprising a pair of tubular brackets each including a U-shaped portion having a vertical fore section and a vertical aft section, and an L-shaped portion integral with said U-shaped portion with the short leg of said L-shaped portion turned toward said U-shaped portion, said brackets being fastened to said stern platform so that said vertical fore section extends from one surface of said platform and said short leg of said L-shaped portion extends from the other surface of said platform, said lower unit comprising a tubular member defined by a central section and two parallel end sections integral with said central section disposed in planes substantially perpendicular to said central section, said end sections being substantially identical and comprising a first short leg joined at one end to said central section, a long leg joined at one end to the other end of said first short leg and a second short leg joined at one end to the other end of said long leg, said legs of each end section all lying in one plane with said long leg being approximately perpendicular to said first short leg and said second short leg extending from said long leg at an acute angle toward said first short leg, said end sections being spaced apart approximately the distance between said brackets and planking fixed to said second short legs of said end sections spanning the distance between them and forming a step, said end sections of said lower unit being hinged to said aft sections of said U-shaped portions of said brackets adjacent a corner thereof whereby said lower unit may be moved between a raised position where said step is positioned above said platform and a lowered position where said step is positioned below and astern of said platform.

12. The ladder of claim 11 wherein said lower unit end sections are positioned outside said brackets and said central section in the lowered position of said lower unit abuts against parts of said brackets to limit the downward movement of said lower unit.

13. The ladder of claim 12 wherein said brackets bear transverse washers and there are mounting plates with end channel portions to receive said washers to lock said brackets to said plates.

14. The ladder of claim 13 wherein quick-release pins are used to fix said brackets and said plates to the transom platform of a boat.

* * * * *